US006901621B2

(12) United States Patent
Bruneau

(10) Patent No.: US 6,901,621 B2
(45) Date of Patent: Jun. 7, 2005

(54) SCALING BAR

(75) Inventor: Marcellin Bruneau, Monbeillard (CA)

(73) Assignee: Atelier D'Usinage Laquerre & Fils, Evain (CA)

( * ) Notice: Subject to any disclaimer, the term of this patent is extended or adjusted under 35 U.S.C. 154(b) by 0 days.

(21) Appl. No.: 10/391,957

(22) Filed: Mar. 10, 2003

(65) Prior Publication Data

US 2004/0012005 A1 Jan. 22, 2004

Related U.S. Application Data

(60) Provisional application No. 60/399,252, filed on Jul. 19, 2002.

(51) Int. Cl.[7] ..... B66F 15/00
(52) U.S. Cl. ..... 7/166; 254/25
(58) Field of Search ..... 254/25; 125/43; 7/104, 166

(56) References Cited

U.S. PATENT DOCUMENTS

| | | | | |
|---|---|---|---|---|
| 119,770 A | * | 10/1871 | Ives | 254/25 |
| 138,599 A | | 5/1873 | Wright et al. | |
| 546,521 A | | 9/1895 | Gatti | |
| 840,580 A | | 1/1907 | McMillan | |
| 1,833,451 A | * | 11/1931 | Amera | 254/25 |
| 2,577,924 A | | 12/1951 | Shacikoski | |
| 2,894,720 A | * | 7/1959 | Bennett | 254/25 |
| 3,587,121 A | | 6/1971 | Morrow | |
| 3,619,009 A | | 11/1971 | O'Leary | |
| 4,745,651 A | | 5/1988 | Schellenger | |
| 5,409,300 A | | 4/1995 | Bourgoin | |
| 6,257,553 B1 | * | 7/2001 | Khachatoorian | 254/25 |

* cited by examiner

*Primary Examiner*—James G. Smith
(74) *Attorney, Agent, or Firm*—François Martineau

(57) ABSTRACT

A scaling bar for prying overhanging rocks from rocky wall structures. The scaling bar comprises an elongated tubular shaft and a first pick member attached to one end thereof, and, optionally, a second pick member attached to a second end thereof. At least one of the two pick members comprises an end portion closely fitted into engagement with the tubular shaft, a tip portion defining a substantially sharp leading edge for easier penetration in the rocky structure, and a cam element. The cam element comprises a first and a second leverage bulges, whereby by displacing the shaft, a lever is formed for dislodging unstable overhanging rocks with minimized physical effort from the workman. The second inner leverage bulge provides greater leverage to the tip portion than the first leverage bulge, but the size of the first leverage bulge is smaller, and can hence engage narrower clefts than the second leverage bulge. In use, a workman axially inserts the pick member of the scaling bar in a cleft adjacent to an unstable overhanging rock, and applies a transverse load by prying the unstable rock using the leverage provided by the first leverage bulge, hence widening the cleft. Subsequently, if necessary, the pick member is further axially driven into the cleft, and the workman again applies a transverse load to pry the rock away again using the leverage provided by the second leverage bulge. This procedure can be repeated so as to sink further into the rock bed, until the rock has been dislodged from its bed.

10 Claims, 5 Drawing Sheets

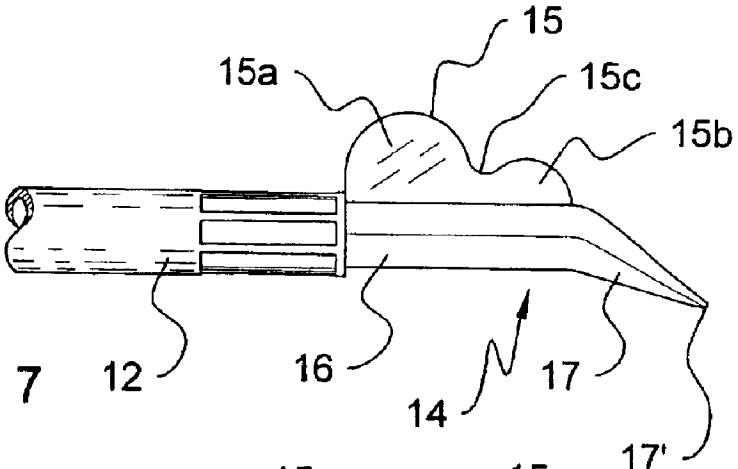
Fig. 7
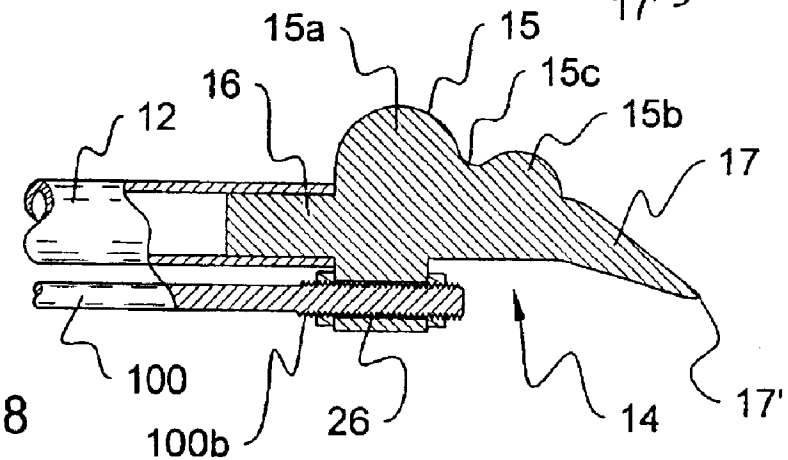
Fig. 8
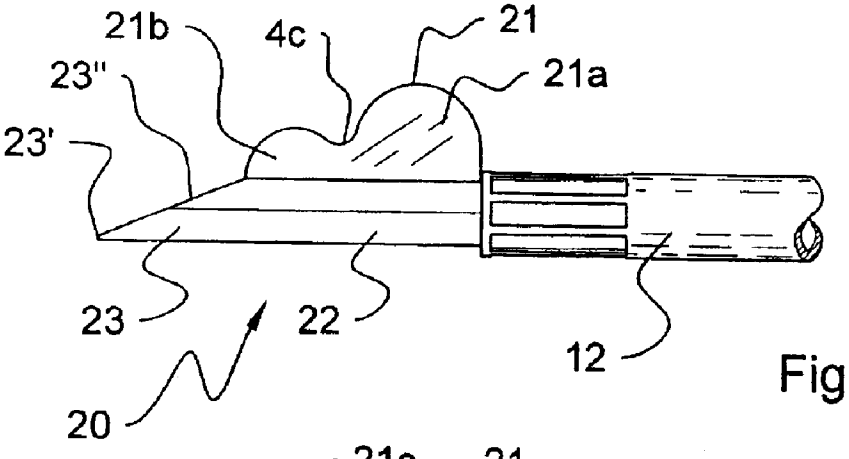
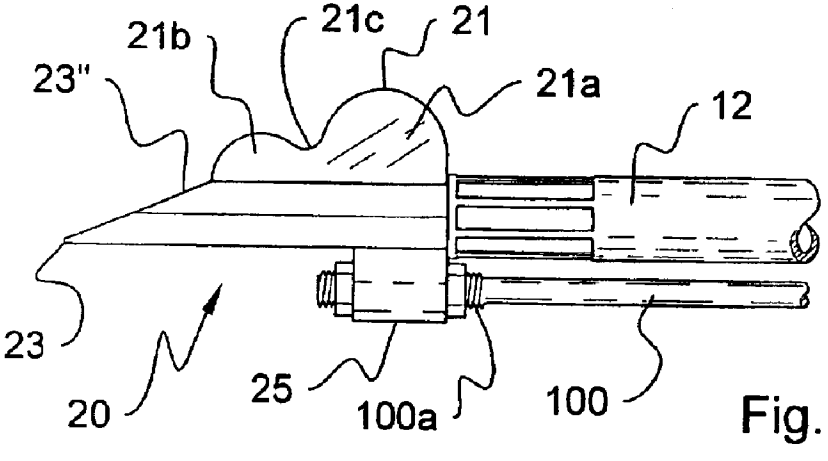

SCALING BAR

This patent application claims priority of co-pending U.S. Provisional patent application No. 60/399,252 filed on Jul. 19, 2002

FIELD OF THE INVENTION

The invention is in the field of scaling bars for use by miners and other workmen to pry loose rocks or other materials from the side wall or roof of a tunnel, mine shafts, or the like.

BACKGROUND OF THE INVENTION

In galleries of subterranean mines, it often occurs that overhanging loose rocks appear on wall surfaces, for example after the dynamiting of a mine shafts. It is essential to regularly remove these unstable rocks, as a safety precaution against injuries to mine workers.

It is known to use scaling bars for this purpose. Such scaling bars are elongated rigid tools comprising a penetrating pick tip at one end thereof, for insertion between unstable rocks. An elbowed section of the rigid tool forms a lever, for enabling a mine worker to dislodge these rocks with reduced physical effort. More particularly, these scaling tools have a cam element adjacent the pick end, to provide extra leverage. However, these known scaling tools are still relatively inefficient.

Moreover, scaling bars can be made of a hollow aluminum tube having scaling picks inserts. Such scaling bars, having generally eight feet or more in length can easily be bent out of shape, under the influence of bending strains induced in the aluminum tube while in use.

SUMMARY OF THE INVENTION

The present invention relates to a scaling bar for prying overhanging rocks from rocky wall structures. The scaling bar comprises an elongated tubular shaft and a first pick member attached to one end thereof, and, optionally, a second pick member attached to a second end thereof. At least one of the two pick members comprises an end portion closely fitted into engagement with the tubular shaft, a tip portion defining a substantially sharp leading edge for easier penetration in the rocky structure, and a cam element. The cam element comprises a first and a second leverage bulges, whereby by displacing the shaft, a lever is formed for dislodging unstable overhanging rocks with minimized physical effort from the workman. The second inner leverage bulge provides greater leverage to the tip portion than the first leverage bulge, but the size of the first leverage bulge is smaller, and can hence engage narrower clefts than the second leverage bulge. In use, a workman axially inserts the pick member of the scaling bar in a cleft adjacent to an unstable overhanging rock, and applies a transverse load by prying the unstable rock using the leverage provided by the first leverage bulge, hence widening the cleft. Subsequently, if necessary, the pick member is further axially driven into the cleft, and the workman again applies a transverse load to pry the rock away again using the leverage provided by the second leverage bulge. This procedure can be repeated so as to sink further into the rock bed, until the rock has been dislodged from its bed.

The present invention also relates to a scaling bar, comprising an elongated shaft having opposite first end and second end, a pick member attached to said first end of said elongated shaft, said pick member comprising an outer tip portion and an inner cam member, said cam member comprising a first and a second axially offset leverage bulge, said first leverage bulge being smaller in size than said second leverage bulge; wherein said first leverage bulge is located intermediate said tip portion and said second leverage bulge.

Said tip portion of said pick member could be either V-shaped or beveled, hence defining a substantially sharp leading edge; or could be elbowed relative to a lengthwise axis defined by said elongated shaft. A second pick member could also be attached to said second end of said elongated shaft.

Preferably, said second pick member comprises an inner end portion anchored to said shaft, an outer V-shaped portion defining a substantially sharp leading edge, and an intermediate arcuate leverage portion integrally mounted to said inner end portion and outer V-shaped tip portion of said second pick member.

A flexible core cable could be added, fixedly interconnecting said first and second pick members, said core cable stretched therebetween for attenuating bending moments of force induced in said shaft while said scaling bar is being handled.

The present invention also relates to a scaling bar, for use in prying overhanging unstable rocks off a rocky wall structure, comprising an elongated shaft, having opposite first end and second end, a pick member attached to said first end of said elongated shaft, said pick member comprising an outer tip portion defining a substantially sharp leading edge for easing axial driving of said pick member in the rocky wall structure, and an inner cam member, said cam member comprising a first leverage means and a second leverage means, said first leverage means providing greater leverage to said tip portion than said second leverage means.

Reinforcement means could then fixedly interconnect first pick member and second pick members, for attenuating bending moments of force induced in said shaft while said scaling bar is being handled.

The present invention also relates to a portable prying tool for use by miners on mineshaft walls, said prying tool including:

a handle;

a driving head, attached to said handle, said driving head for engagement through small wall cavities on the mineshaft walls;

first cam means, co-operating with said handle for providing fine-grade leverage force to increase the penetration depth of said driving head into the wall cavities of the mineshaft walls; and second cam means, co-operating with said handle and with said first cam means for providing coarse-grade leverage force to further increase penetration depth of said driving head into the wall cavities of the mineshaft walls, beyond that enabled by said first cam means.

A second driving head could be added, integral to said handle at a location spacedly opposite the first mentioned driving head.

Preferably, third cam means is added, co-operating with said handle for providing fine-grade leverage force to increase the penetration depth of said second driving head into the wall cavities of the mineshaft walls, and fourth cam means is added, co-operating with said handle and with said third cam means for providing coarse-grade leverage force to further increase penetration depth of said second driving head into the wall cavities of the mineshaft walls, beyond that enabled by said third cam means.

Said first mentioned driving head and said second driving head could be coaxially mounted, with a flexible tensioning member being added, fixedly spacedly interconnecting said second driving head and the first mentioned driving head.

Said tensioning member could either extend coaxially to said first mentioned driving head and to said second driving head, or alternately, could define a lengthwise axis being axially offset relative to said first mentioned driving head and to said second driving head but parallel thereto.

DESCRIPTION OF THE DRAWINGS

In the annexed drawings:

FIG. 7 is a view similar to FIG. 6, but with the bar tilted a quarter of a turn;

FIG. 8 is a view similar to FIG. 7, but showing a structural integrity enhancing cable mount;

DETAILED DESCRIPTION OF THE EMBODIMENTS

Figure 1:
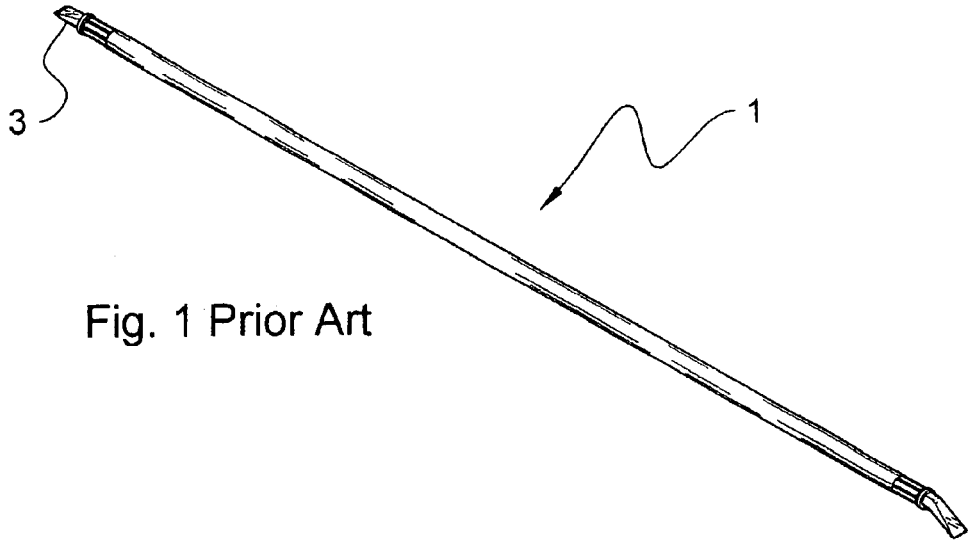
Fig. 1 Prior Art
FIG. 1 is a perspective view of a scaling bar according to prior art.
Figure 2:
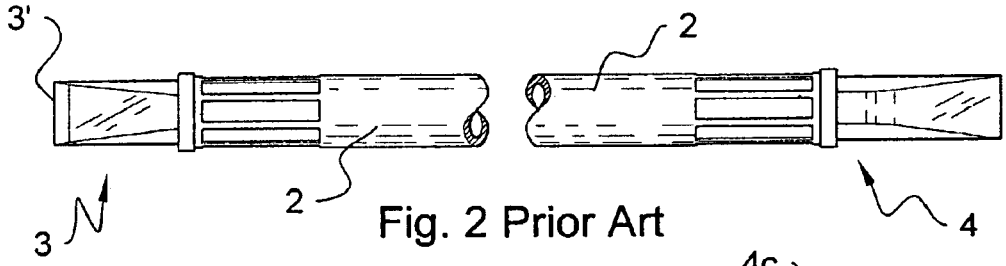
Fig. 2 Prior Art
FIG. 2 is an enlarged top plan view of the scaling bar of FIG. 1, shown partly broken for clarity of the view.
Figure 3:
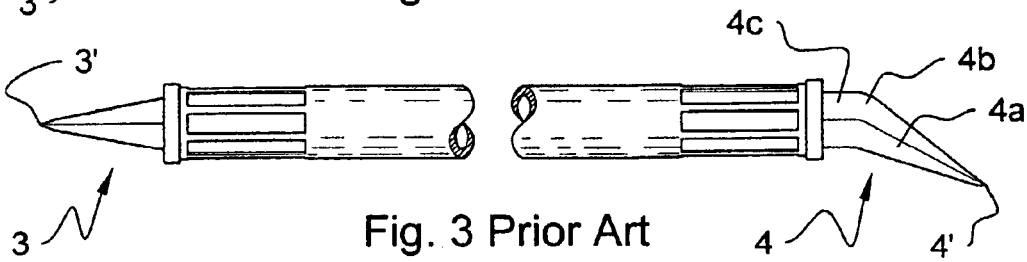
Fig. 3 Prior Art
FIG. 3 is a view similar to FIG. 2, but with the bar tilted a quarter of a turn.
Figure 4:
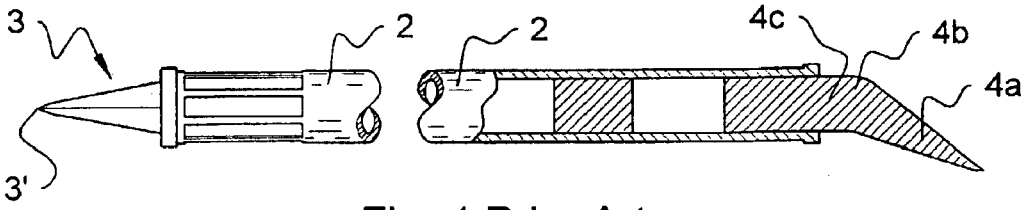
Fig. 4 Prior Art
FIG. 4 is a view similar to FIG. 3, but showing a sectional view of one end portion of the bar.

FIGS. 1 to 4 show a scaling bar 1 according to prior art. Scaling bar 1 comprises two pick ends 3 and 4 installed on opposite ends of a shaft 2. Pick end 3 is V-shaped and defines a leading edge 3'. Pick end 4 comprises a V-shaped tip portion 4*a* defining a leading edge 4', an elbow 4*b*, and a straight end portion 4*c*.

Figure 5:
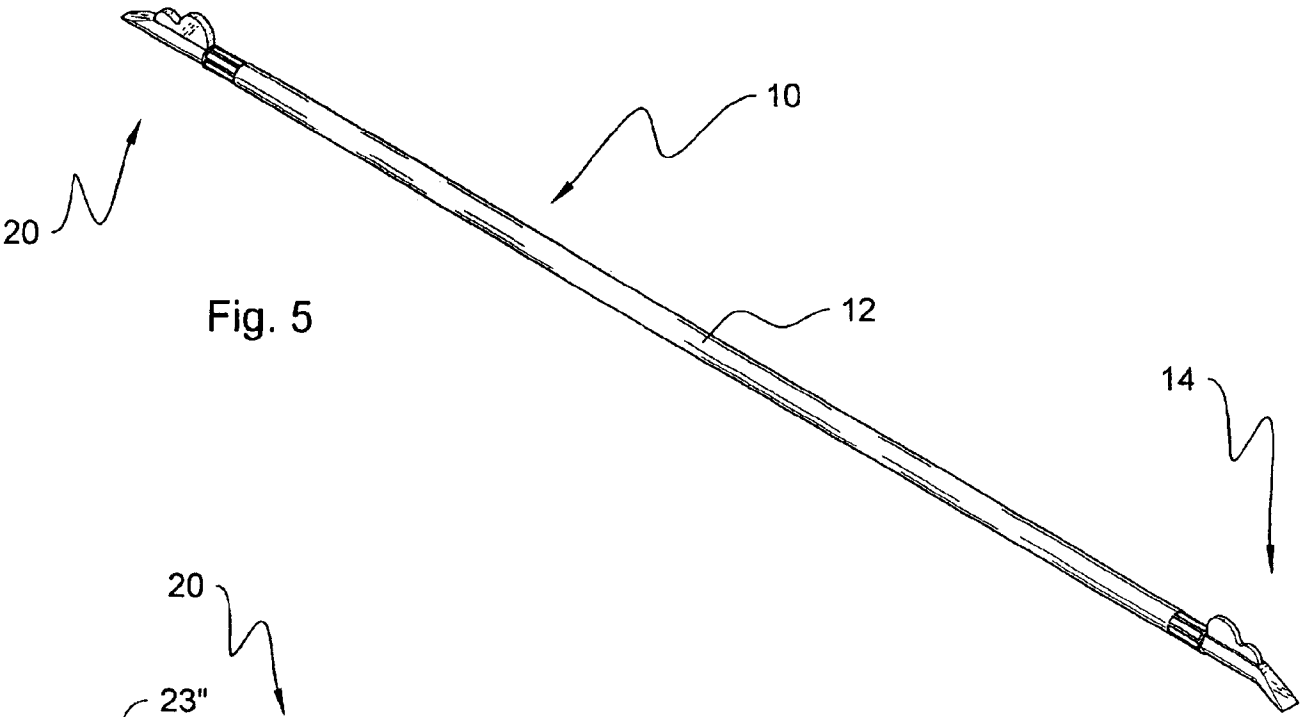
FIG. 5 is a perspective view of a scaling bar according to a first embodiment of the invention.

With further reference to FIG. 5, a scaling bar 10 is illustrated according to a first embodiment of the present invention. Scaling bar 10 is used for dislodging hazardous loose rocks clung on to wall structures of mine shafts, which, if not removed, can unexpectedly fall on miners or other workmen, hence causing serious bodily injuries.

Scaling bar 10 comprises an elongated shaft 12 having a pick member 14 firmly attached coaxially to one end thereof, and a pick member 20 fixedly attached coaxially to the other end thereof.

Shaft 12 can be for example an aluminum hollow tube having a circular or polygonal (e.g. quadrangular) cross-section, and can have varying lengths. The length of shaft 12 could vary for example between 8 to 14 feet. Opposite pick members 14 and 20 should be made from a much stronger material relative to shaft tube 12, for example from heavy-cast iron alloy.

Figure 6:
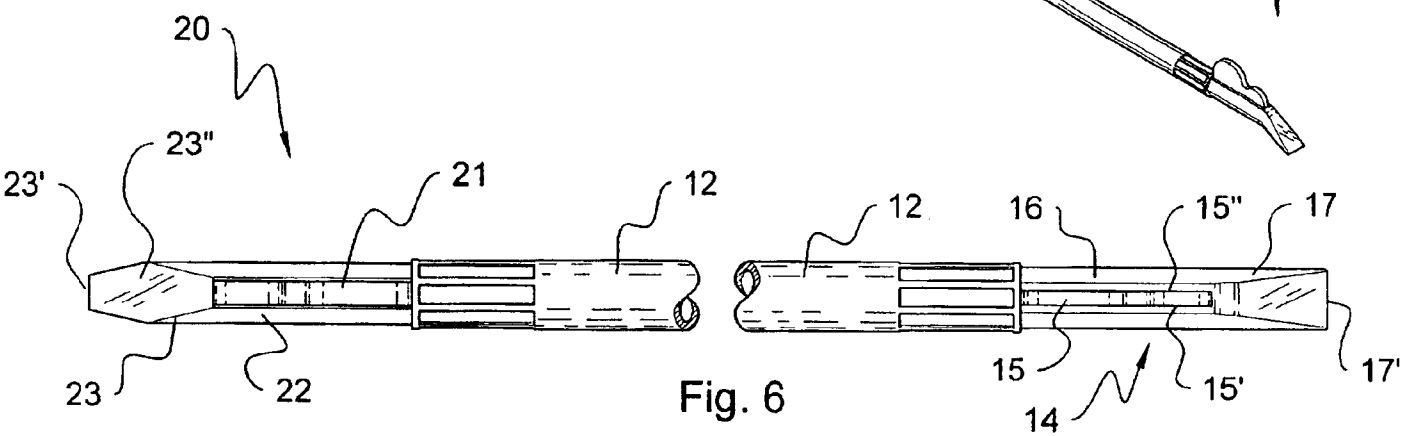
FIG. 6 is a top plan view at an enlarged scale of the scaling bar of FIG. 5, shown partly broken for clarity of the view.

As illustrated in FIG. 7, pick member 14 comprises the following integral elements : a straight inner portion 16, an elbowed outer tip portion 17 and an inner cam member 15 integrally projecting outwardly radially from inner portion 16. Straight portion 16 is aligned coaxially with shaft 12, and can for example have an hexagonal cross-section. Elbowed tip portion 17 extends from the outer end of straight portion 16; the elbow angle of elbowed tip portion 17 is acute, for example ranging between 30° to 45° Tip portion 17 is V-shaped, hence defining a substantially sharp leading edge 17' for better insertion in clefts present into rocky wall structures. Moreover, cam member 15 is provided on pick member 14, cam member 15 integrally projecting radially outwardly from inner portion 16. Cam member 15 is used as leverage means for prying away loose rocks from wall structures of mine shafts. Cam member 15 comprises two leverage bulges 15*a* and 15*b* which are separated by a recess 15*c*. The size of bulge 15*b*, located on the outer end of straight portion 16 adjacent to tip portion 17, should be significantly smaller than that of bulge 15*a*, which is located on the inner end of straight portion 16 opposite tip portion 17. For example, outer bulge 15*b* could increase by 50% the diameter of straight portion 16, and inner bulge 15*a* by 100%. Other relative sizes of bulges 15*a* and 15*b* are not excluded from the scope of the invention. Bulges 15*a* and 15*b* have a substantially semi-circular cross-section. Cam element 15 may comprise two opposite planar faces 15', 15" parallel to the central axis of elongated shaft 12, as illustrated in FIG. 6.

As illustrated in FIG. 7, the geometry of the two opposite pick members 16 and 23 is very similar. Both pick members 16 and 23 comprise similar straight portions 16 and 22 respectively, and similar cam members 15 and 21 respectively. However, tip portion 23 of pick member 20 differs from tip portion 17 of pick member 14. Tip portion 23 is a non-elbowed coaxial beveled extension of straight portion 22. A beveled face 23" is defined on tip portion 23, and is sloped downwardly opposite cam member 23. Beveled tip portion 23 thus defines a substantially sharp leading edge 23', and thereby allowing an easier through insertion of pick member 20 in clefts present in mine shaft walls.

In one embodiment, as illustrated in FIG. 8, straight portions 16 and 22 of pick members 14 and 20 respectively are inserted within the inner periphery of tubular shaft 12 and suitably firmly attached thereto, by means of rivets, screws and bolts, welding, press fitting, or other suitable means known in the art.

Figure 9:
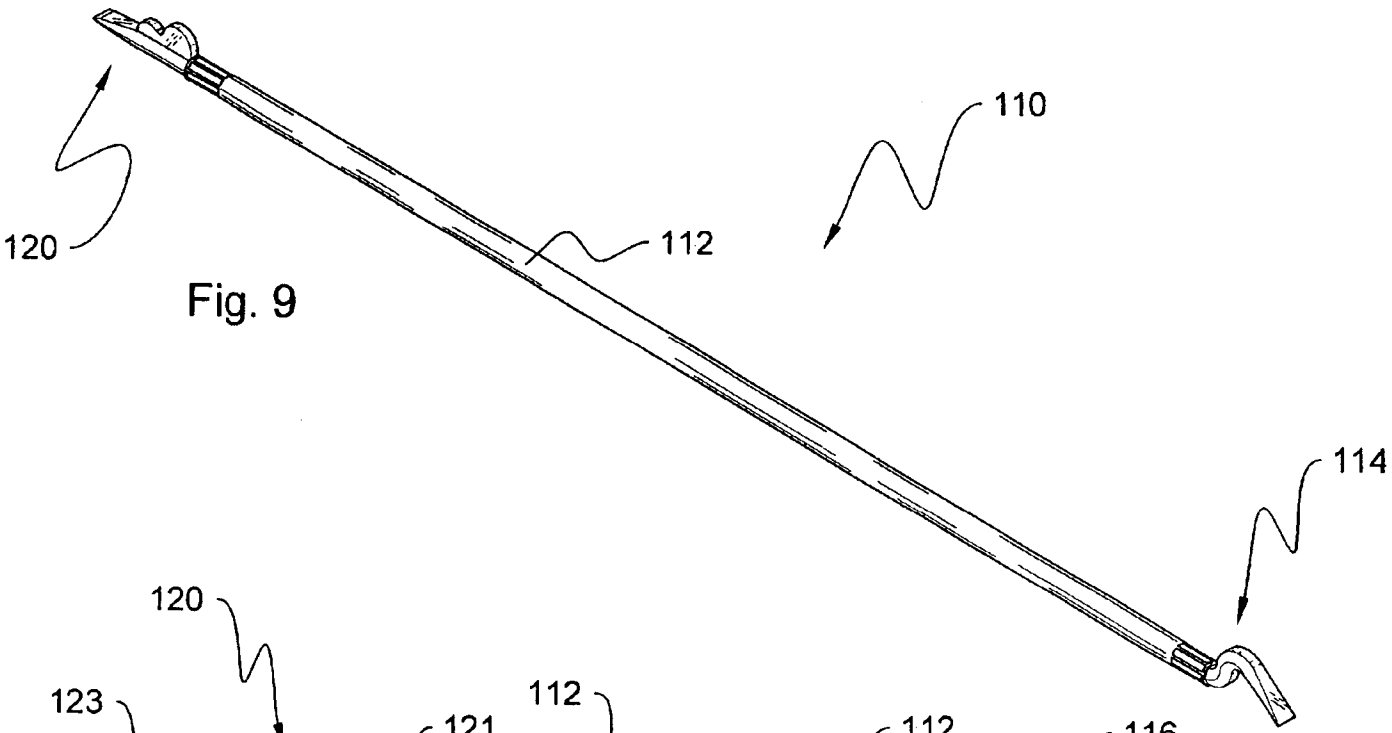
FIG. 9 is a perspective view of a scaling bar according to a second embodiment of the invention.
Figure 10:
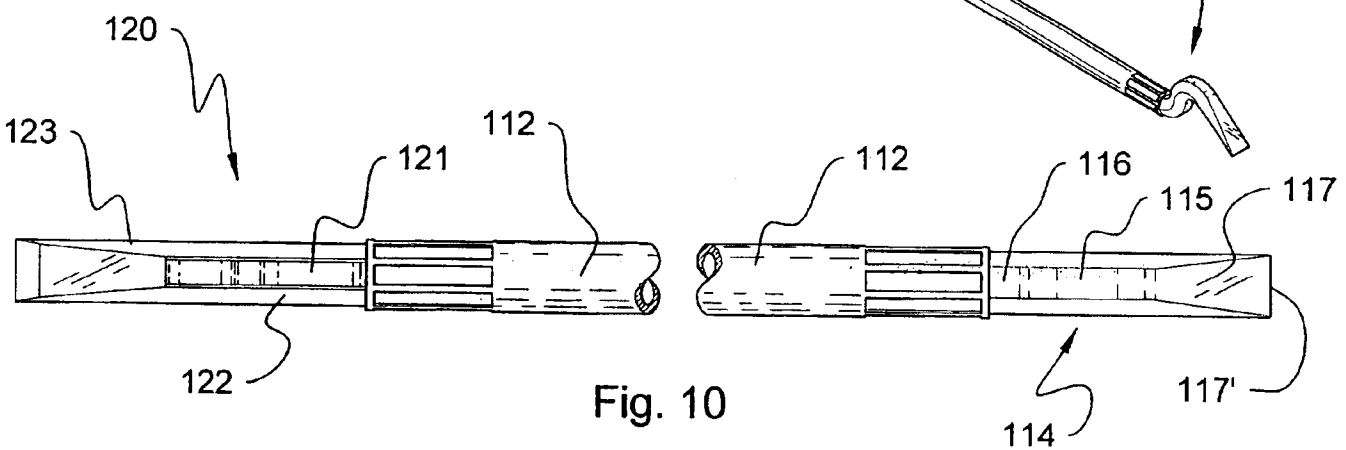
FIG. 10 is an enlarged top plan view of the scaling bar of FIG. 9, broken at its mid portion to fit the sheet window.

In FIG. 9, there is shown an alternate embodiment of the scaling bar of the invention, which will be further referred to as scaling bar 110. Scaling bar 110 comprises an elongated shaft 112 similar to shaft 12 of scaling bar 10, and two pick members 114 and 120 firmly attached to opposite ends of shaft 112.

Figure 11:
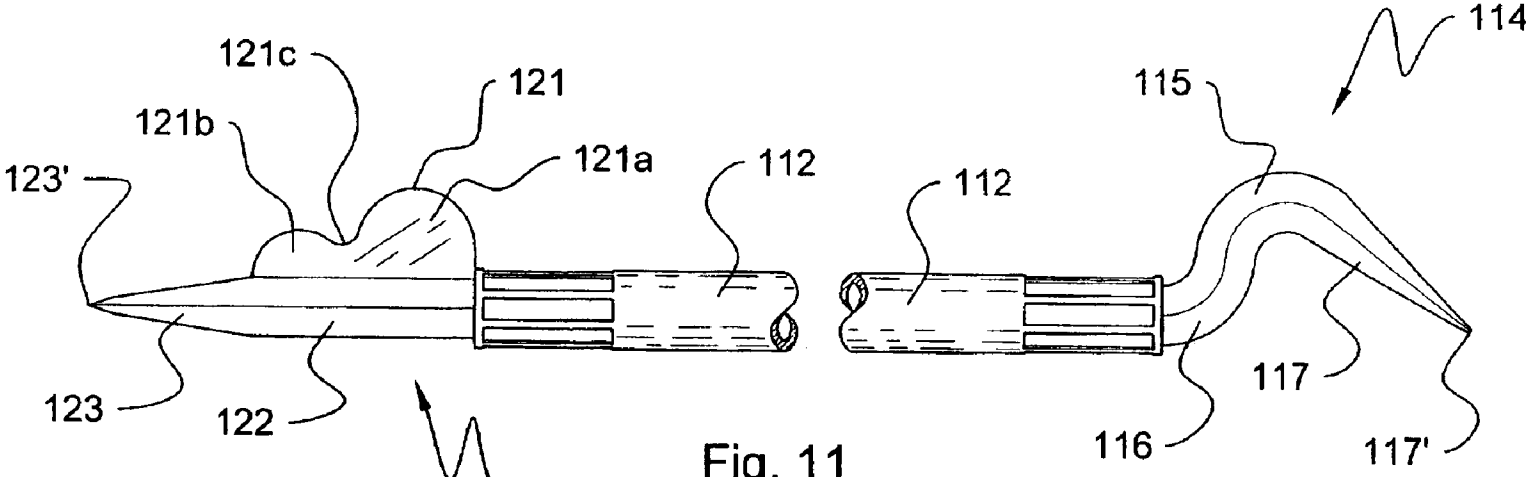
FIG. 11 is a view similar to FIG. 10, but with the bar tilted a quarter of a turn.
Figure 12:
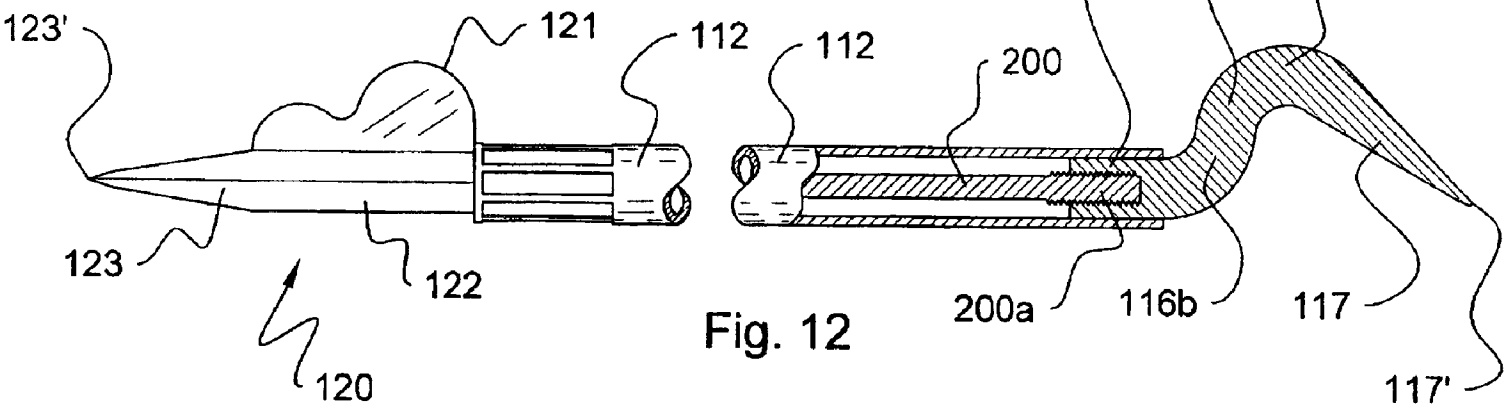
FIG. 12 is a view similar to FIG. 11, but showing one end portion of the bar in sectional view, and further showing an alternate structural integrity enhancing cable mount.

As illustrated in FIGS. 11 and 12, pick member 114 comprises an inner end portion 116, an intermediate elbowed arcuate portion 115, and an outer tip portion 117 coextensive to one another. Leverage portion 115 is meant to abut on the wall structure (side wall or roof) of a mine shaft or the like as leverage means for prying away loose rocks clinging thereon and allowing these rocks to fall down in a controlled way not hazardous to coworkers. Tip portion 117 is V-shaped, hence defining a leading edge 117' for easier insertion in clefts on a wall structure of a mine shaft.

In one embodiment, as shown in FIG. 12, end portion 116 of pick member 114 comprises an inner straight portion 116*a* and an arcuately elbowed intermediate portion 116*b*.

Straight portion 116*a* is closely fitted into engagement through a tube mouth 112*a* and into the inner peripheral wall of tubular shaft 112, and is firmly secured thereto with screws, rivets, or other suitable means known in the art.

Pick member 120 has a very similar geometry to that of pick member 20. It comprises a cam member 121 identical to cam member 21, and a straight portion 122 identical to straight portion 22. However, it comprises a V-shaped (double-bevel) tip portion, hence defining a substantially sharp leading edge 123' aligned coaxially with shaft 112.

In alternate embodiments, as displayed in FIGS. 8 and 12, provision has been made for a core cable 100, 200 respectively reinforcing tubular shafts 12, 112 respectively, and joining pick members 14 and 20, 114 and 120 together respectively. As illustrated in FIG. 8, core cable 100 having opposite threaded end portions 100*a*, 100*b*, is installed on tubular shaft 12 in axially offset fashion parallel thereto, in a diametrically opposite fashion relative to cam member 15. More specifically, core cable end portions 100*a*, 100*b* are each inserted through threaded channel 26 located in a supporting member 25, the latter being integrally mounted on both pick members 14 and 20 radially outwardly thereof. Core cable 100 is suitably secured therewith by means of nuts screwed onto its threaded end portions 100*a*, 100*b*. Alternatively, as illustrated in FIG. 12, core cable 100 can be installed coaxially with and within the inner walls of tubular shaft 112. The opposite threaded end portions 200*a* of core cable 200 engage a threaded socket 202 recessed into the end portion of pick members 114 and 120 located within the inside of tubular shaft 112.

In both configuration of FIGS. 8 and 12, core cable 100, 200 strongly pulls and maintains together pick members 14 and 20 and pick members 114 and 120 respectively, so as to substantially relieve structurally weaker but much lighter tubular body 112 from bending moment of forces. Core cables 100, 200 are particularly useful for scaling bars in the high end of operational lengths, for example from 12 to 14 feet in length.

Scaling bar 10 or 110 is generally used to dislodge loose overhanging rocks that often appear on wall surfaces after the dynamiting of mine shafts. The following description will depict the usage of pick member 14 of scaling bar 10 exclusively, for clarity purposes; pick member 20 of scaling bar 10 and pick member 120 of scaling bar 110 are meant to be used in a similar fashion. Bulge 15*a* and 15*b* of cam member 15 provide leverage for the tip portion 17, hence rendering the dislodging of the loose rock less physically demanding on the workman maneuvering scaling bar 10. Bulge 15*b* being bigger than bulge 15*a*, the former provides greater leverage than the latter. In practice, tip portion 17 followed by bulge 15*a* are first axially inserted in a cleft too narrow for bulge 15*b* to be inserted therein as well. Transverse lever pressure is then applied on the shaft to try to pry the loose rock out of its bed and widen the cleft. If necessary, the pick member can then be further axially driven into the cleft, allowing for bulge 15*b* to penetrate therein as well. Transverse lever pressure is then applied on the shaft once again to pry the loose rock further out of it bed. This procedure can be repeated at different locations around the loose rock to fully pry it away from the wall surface, allowing it to cling off the wall of the mine shaft and to fall on the ground.

It has been found that unexpectedly high performance was achieved with elbowed tip portions 17, 117, due to the specific elbow shape, compared to conventional crow bar having an elongated handle.

Returning to the prior art scaling bar 1, illustrated in FIGS. 1 through 4, elbow 4*b* located onto pick end 4 provides leverage to the tip portion 4*c*. However, such leverage means have been found to be quite inefficient. The double-bulged cam member 15, 21, 121 located on the pick members of the scaling bars of the present invention have also unexpectedly been found to provide much more efficient leverage means to the adjacent tip portion.

The different shapes of pick members described hereinabove provide miners or other workmen a plurality of different tools for prying away loose rocks embedded in a wall structure. Each scaling bar 10, 110 being provided with two opposite pick members, the workman can, by tilting the scaling bar one half turn, alternate between both pick members while scaling a mine shaft wall structure. In one embodiment, pick members are releasably mounted to the tubular body 12, 112, allowing for them to be interchangeable, adding a modular capacity to the scaling bar of the invention which enhances the versatility of the tool 10, 110.

In an embodiment of the invention not shown in the appended figures, the scaling bar could include only one end pick member, this pick member being shaped similarly to pick member 14, 20 or 120, and hence comprising a double-bulged camel-back-like cam element.

In use, shaft 12 or 112 may withstand a great deal of transverse bending moments of force. In the embodiments illustrated in both FIGS. 8 and 12 wherein a core cable 100 is installed on shaft 12 or 112, core cables 100, 200 attenuate bending loads resulting from lever prying rocks off hard wall structures. Indeed, core cables 100, 200 being strongly stretched between the two pick members, if bending loads are induced in the shaft, the shaft will spring back to its original conformation under the bias of the stretched cable 100, 200. Cables 100, 200 should be made from a material much stronger than tube 12, 112, but also flexible, contrary to the end pick members, for example metallic flexible cable.

In an alternate embodiment, a metallic rod (not shown) can be used instead of a core cable to help preventing excessive warping due to bending loads.

Note that various other configurations of scaling bars could come within the scope of the current invention. FIG. 5 and FIG. 8 represent two distinct embodiments of the scaling bar. However, any one of the above described pick members can be assembled with any other of the pick members on a tubular shaft, yielding a variety of different scaling bars. For each or these scaling bars, provision can be made for an external flexible core cable 100, or an internal flexible cable 200, which may be located inside or radially outside the tubular shaft, as described hereinabove.

What is claimed is:

1. A scaling bar, comprising an elongated shaft having opposite first end and second end, a pick member comprising an elongated straight portion defining an inner end whereby said pick member is attached to said elongated shaft, and an outer end opposite said inner end whereby an outer tip portion projects, said outer tip portion defining a substantially sharp leading edge, said pick member further comprising an inner cam member installed on said straight portion intermediate said inner and said outer ends thereof, said cam member comprising a first leverage bulge and a second leverage bulge axially offset from said first leverage bulge and juxtaposed thereto, said first leverage bulge being smaller in size than said second leverage bulge; wherein said first leverage bulge is located intermediate said tip portion and said second leverage bulge; and further including a second pick member, attached to said second end of said elongated shaft, and a flexible core cable, fixedly interconnecting said first and second pick members, said core cable stretched therebetween for attenuating bending moments of force induced in said shaft while said sealing bar is being handled.

2. A scaling bar according to claim 1,
wherein said tip portion of said pick member is beveled, hence defining said substantially sharp leading edge.

3. A scaling bar according to claim 1,
wherein said zip portion of said pick member is V-shaped, hence defining said substantially sharp leading edge.

4. A scaling bar according to claim 3,
wherein said tip portion of said pick member is elbowed by an acute angle relative to a lengthwise axis defined by said elongated shaft.

5. A scaling bar according to claim 1,
wherein said second pick member comprises an inner end portion anchored to said shaft, an outer V-shaped portion defining a substantially sharp leading edge, and an intermediate arcuate leverage portion integrally mounted to said inner end portion and outer V-shaped tip portion of said second pick member.

6. A portable prying tool for use by miners on mineshaft walls, said prying tool including:

a) a handle;

b) a driving head, attached to said handle, said driving head comprising an elongated straight portion and an outer tip portion at one end thereof defining a substantially sharp loading edge, said driving head for engagement through small wall cavities on the mineshaft walls;

c) first cam means provided on said driving head straight portion, co-operating with said handle for providing fine-grade leverage force to increase the penetration depth of said driving head into the wall cavities of the mineshaft walls; and d) second cam means provided on said driving head straight portion and juxtaposed to said first cam means, co-operating with said handle and with said first cam means for providing coarse-grade leverage force to further increase penetration depth of said driving head into the wall cavities of the mineshaft walls, beyond that enabled by said first cam means;

e) a second driving head, integral to said handle at a location spacedly opposite the first mentioned driving head; and wherein said first mentioned driving head and said second driving head are coaxially mounted, and further including a flexible tensioning member, fixedly spacedly interconnecting said second driving head and the first mentioned driving head.

7. A prying tool as in claim 6,
further including third cam means, co-operating with said handle for providing fine-grade leverage force to increase the penetration depth of said second driving head into the wall cavities of the mineshaft walls; and fourth cam means, co-operating with said handle and with said third cam means for providing coarse-grade leverage force to further increase penetration depth of said second driving head into the wall cavities of the mineshaft walls, beyond that enabled by said third cam means.

8. A prying tool as in claim 6,
wherein said tensioning member extends coaxially to said first mentioned driving head and to said second driving head.

9. A prying tool as in claim 6,
wherein said tensioning member defines a lengthwise axis being axially offset relative to said first mentioned driving head and to said second driving head but parallel therein.

10. A scaling bar, comprising an elongated shaft having opposite first end and second end, a pick member attached to said first end of said elongated shaft, said pick member comprising an outer tip portion and an inner cam member, said cam member comprising a first leverage bulge and a second leverage bulge axially offset from said first leverage bulge, said first leverage bulge being smaller in size than said second leverage bulge; wherein said first leverage bulge is located intermediate said tip portion and said second leverage bulge;
wherein said scaling bar further includes a second pick member, attached to said second end of said elongated shaft, and wherein said scaling bar further includes a flexible core cable, fixedly interconnecting said first and second pick members, said core cable stretched therebetween for attenuating bending moments of force induced in said shaft while said scaling bar is being handled.

* * * * *